US008336458B2

(12) United States Patent
Baumann et al.

(10) Patent No.: US 8,336,458 B2
(45) Date of Patent: Dec. 25, 2012

(54) GASTIGHT ELECTRICAL BUSHING AND ITS USE IN A PROJECTILE

(75) Inventors: Christian Baumann, Martinsrieth (DE); Torsten Niemeyer, Lachendorf (DE); Juergen Pellnath, Suderburg (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 401 days.

(21) Appl. No.: 12/495,912

(22) Filed: Jul. 1, 2009

(65) Prior Publication Data

US 2010/0132579 A1 Jun. 3, 2010

(30) Foreign Application Priority Data

Jul. 1, 2008 (DE) ..... 10 2008 030 663

(51) Int. Cl.
*F42B 10/06* (2006.01)
*F42C 19/06* (2006.01)

(52) U.S. Cl. ..... 102/206; 102/439; 102/517

(58) Field of Classification Search ..... 102/200, 102/202, 206, 517, 520, 521, 522, 439, 444, 102/498, 499, 501, 529; 89/6, 6.5
See application file for complete search history.

(56) References Cited

U.S. PATENT DOCUMENTS

| | | | | |
|---|---|---|---|---|
| 4,015,531 | A * | 4/1977 | Ziemba | 102/206 |
| 5,241,909 | A * | 9/1993 | Eches et al. | 102/202 |
| 5,353,710 | A * | 10/1994 | Eches et al. | 102/443 |
| 5,485,787 | A * | 1/1996 | Bowcutt et al. | 102/374 |
| 2010/0132579 | A1 * | 6/2010 | Baumann et al. | 102/439 |

* cited by examiner

*Primary Examiner* — James Bergin
(74) *Attorney, Agent, or Firm* — Lucas & Mercanti, LLP; Klaus P. Stoffel

(57) ABSTRACT

A projectile in which the metallic base body itself is used as a ground wire and only the signal line is passed through the inside of the base body so that it is insulated by a suitable bore of the base body. The signal line is insulated from the ground wire by a coating of an electrically insulating material applied to the base body, before the signal line is introduced into the bore. The two ends of the signal line are provided with connecting contacts, which preferably can be screwed at least partially into the base body and are mounted in such a way that they are insulated from the base body. To allow contacting of the ground wire, which is formed by the base body itself, the front end and the rear end of the base body are provided with coating-free blind bores.

3 Claims, 3 Drawing Sheets

GASTIGHT ELECTRICAL BUSHING AND ITS USE IN A PROJECTILE

BACKGROUND OF THE INVENTION

The invention concerns a gastight electrical bushing, which can be used, for example, in a tail part of a tail stabilized projectile with an electrically conducting connection, and a method for realizing this bushing.

Projectiles with a detonator with a settable fuse usually contain an insulated electric signal line for programming the ignition point of the detonator as well as a grounded line (which shall also be referred to as a ground wire). In previously known tailpiece-stabilized projectiles, a cable that contains the signal line and the ground wire passes axially through the rear end of the projectile. The interface between the propulsion chamber, which is subject to high pressure and temperature loads, and the receiver (e.g., a detonator) must be protected with expensive components, since no gas may be allowed to penetrate the projectile. Since pressures of several 1,000 bars and extremely hot gases act on the tail support when the projectile is fired in a gun barrel, expensive gastight bushings for the cable must be provided in the tail support. Moreover, these bushings also must not undergo any change as a result of the high accelerations of several 10,000 g that act on them when the projectile is fired. Accordingly, a gastight bushing, whose placement is complicated, is used in practice in a shell with a signal line. In previously known projectiles, the cables containing the signal line and the ground wire are inserted in a suitable axial bore in the respective tail support and sealed with a suitable medium. The ends of the signal line and the ground wire are then soldered with corresponding electrical lines of adjacent components.

SUMMARY OF THE INVENTION

The objective of the invention is to provide a simple gastight bushing of the aforementioned type, which realizes a conductive electrical line, preferably in a projectile.

The invention is based on the idea of realizing the gastight electrical bushing by an insulated outer body and a metallic, electrically conducting inner conductor. The invention provides that a base body, for example, a tail stabilizer of a projectile, takes on (preferably itself) this function of the ground wire/signal line. The metallic base body forms the ground wire, and only the signal line, which is insulated inside the base body, is passed through a suitable bore in the base body, such that the signal line is intended to essentially fill the bore.

The base body is preferably machined and is furnished with a nonconductive coating on all sides, i.e., also inside all bores to be insulated and over all threads. In this way, in continuation of the invention, the signal line is insulated not by means of an insulating jacket that is wound around the cable but rather by a coating of an electrically insulating material applied to the base body before the signal line is inserted in the bore. The ends of the signal line are provided with connecting contacts, which preferably can be at least partly screwed into the base body and fastened onto the base body but insulated from it. To allow contacting of the ground wire formed by the metallic base body itself, the front side and the rear side of the base body are provided with coating-free bores.

As has already been mentioned, to guarantee safe electrical insulation of the connecting contacts from the ground wire, the threaded areas of the connecting contacts are also wetted with an electrically insulating liquid adhesive, preferably before being screwed into the holes of the base body.

It has also been found to be advantageous for the connecting contacts for connection with the electric conductor to be provided with axially arranged bores, into which the ends of the conductor can be inserted.

If an aluminum alloy is used as the material for the base body, then electrolytically oxidized aluminum is preferably used as the electrically insulating material.

Therefore, the base body according to the invention is suitable especially for producing gastight transmission of electric signals and can be used, for example, in a tail stabilizer-stabilized projectile. In projectiles of this type, it is only necessary, before the application of an electrolytically oxidized aluminum coating to the tail support, to introduce into the tail support an axial bore that passes all the way through for the signal conduction and the preferably threaded regions for the connecting contacts and also to coat the inside walls of the bore and the regions for the connecting contacts with electrolytically oxidized aluminum. The bores for the connections of the ground wire can then be made in the tail support.

To make it possible, even at a later time, to connect a propellant charge primer with the signal lines running in the rear end of the projectile, it has been found to be advantageous if the rear-end connecting contact has an axially extending blind bore on its side that faces away from the base body. The end of a plug contact connected with the propellant charge primer can be inserted into the blind bore, for example, against the pressure of a restoring spring located in the blind bore.

To contact the ground wire of the propellant charge primer with the ground wire of the rear end of the projectile, a grounding screw cap can be provided, which, on the one hand, can engage the coating-free bore of the front side of the base body, if such a bore is present, and, on the other hand, contacts the ground wire of the propellant charge primer, for example, by a sliding contact system.

The propellant charge primer can be connected with the projectile basically by means of threads, pins, springs, fitting pieces or the like. This makes it possible to produce contacting of the lines, and in this connection, it is important that the primer is directly connected with the base body of the projectile. The resulting interface provides reliable contacting between the rear end of the projectile and the propellant charge primer.

The advantage of this design thus also consists in the fact that the propellant charge primer is directly connected with the rear end of the projectile, which results in something like an interface for reliable contacting between the rear end of the projectile and the propellant charge primer. The propellant charge primer can be screwed in from behind, which simplifies the insertion of a shell.

Furthermore, this results in a robust design that is resistant to gas pressure. The design is secure against discharge, because the fastening components are accelerated in such a way by the large surfaces which are directed towards the rear that gastightness is obtained of necessity. It not only has good EMC but also is simple to install.

Further details and advantages of the invention are explained below on the basis of the specific embodiments illustrated in the drawings.

DETAILED DESCRIPTION OF THE INVENTION

Figure 1:
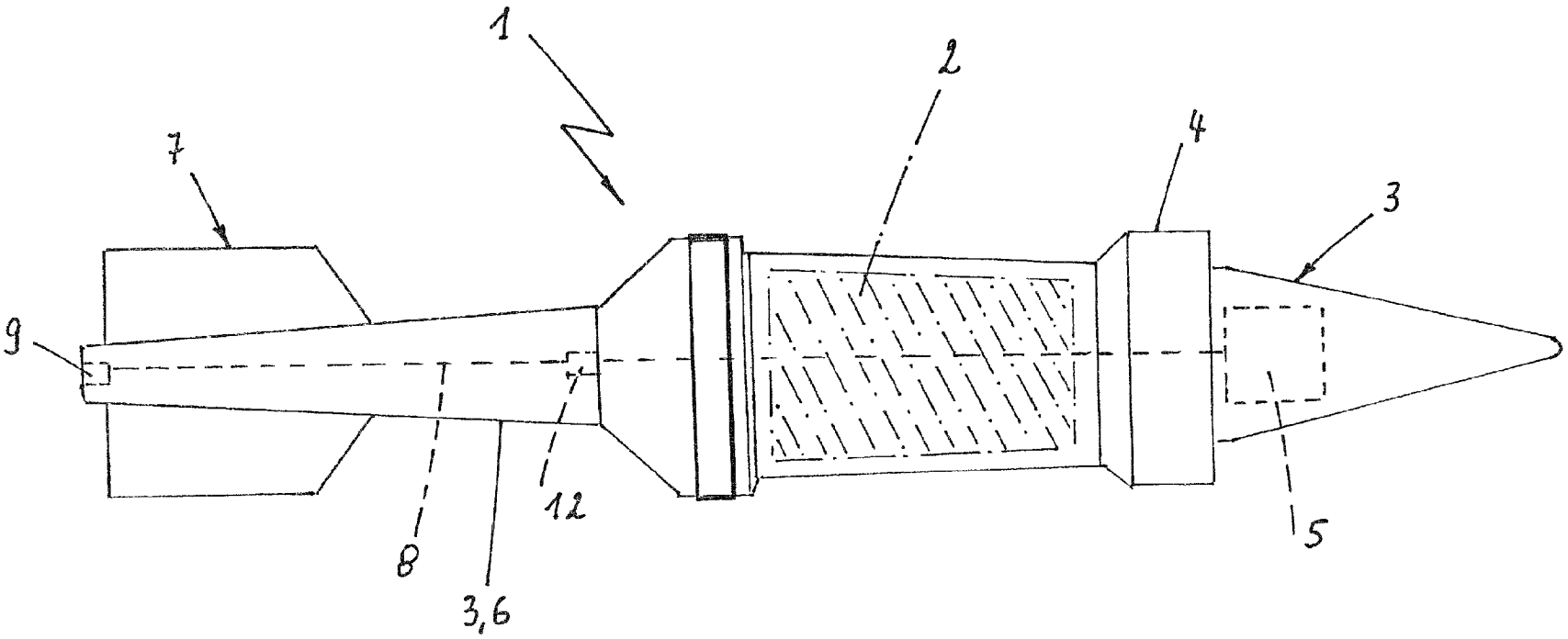
FIG. 1 is a schematic side view of a sabot projectile with a detonator with a settable fuse, in which, in accordance with the invention, the electric signal line is passed through the rear end of the projectile.

FIG. 1 shows a projectile 1, namely, a large-caliber fin-stabilized sabot projectile, which has a projectile body 3 filled with an explosive 2 and a segmentable sabot 4. The projectile body 3 comprises a detonator 5 at the front end with a settable fuse and a base body 6 at the rear end, which consists, for example, of an aluminum alloy, and which in the present case is the tail section of the projectile 1, which supports the tail stabilizer 7 of the sabot projectile 1.

The detonator 5 with the settable fuse is connected by an electrical connection 8 (indicated in FIG. 1 as a broken line) with a first connecting contact 9 located at the rear end of the projectile. A plug contact 11 (FIG. 4), which can be inserted into this connecting contact 9, for example, in the case of cartridged ammunition, is connected by electric lines that run inside a propellant charge primer 10 with electrodes installed on the base body of the casing (not shown) of the given ammunition.

Figure 2:
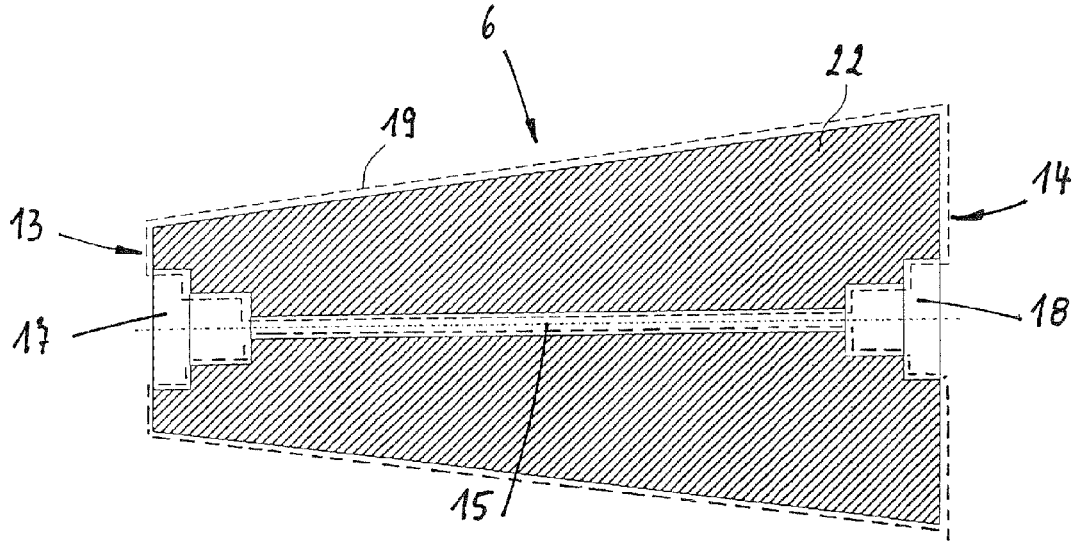
FIGS. 2 to 4 are schematic views of the rear end of a projectile after various steps of the method of the invention have been carried out.

To produce the electrical connection 8 between the first connecting contact 9 located at the rear end and a second connecting contact 12 located at the front end on the tail support 6 (also referred to as the base body), a bore 15 for the signal line 16 of the electrical connection 8, which bore 15 connects the front end 14 and the rear end 13 of the base body 6, is first introduced into the base body 6, and corresponding receiving areas 18, 17, which are provided with internal threads, are introduced into the front end 14 and rear end 13 to receive the connecting contacts 12, 9 for the electrical connection 8 (FIG. 2).

The entire metallic base body 6, including the bore 15 and the receiving areas 17, 18 for the connecting contacts 9, 12, is then coated with an electrolytically oxidized aluminum coating 19.

Coating-free blind bores 20, 21 are then introduced into the base body 6 (FIG. 3), so that the base body 6 can later be contacted with the adjacent ground wires of the neighboring components (propellant charge primer, nose-end section of the projectile), and the base body 6 itself forms the ground wire 22 for a coaxial signal line 16.

The signal line 16 is then inserted into the bore 15, and the connecting contacts 9, 12, which are provided with suitable external threads, are screwed into the receiving areas 17, 18, so that the two ends 23, 24 of the signal line 16 are inserted into corresponding recesses 25, 26 of the connecting contacts 9, 12, and the connecting contacts 9, 12 are electrically conductively connected with each other by the signal line 16.

To ensure that a short circuit is not produced between the connecting contacts 9, 12 and the base body 6 due to damage of the electrolytically oxidized aluminum coating 19 caused by screwing the connecting contacts 9, 12 into the receiving areas 17, 18, the connecting contacts 9, 12 are preferably wetted with a liquid adhesive (for example, Kleberit). This results in the creation of additional insulation between the connecting contacts 9, 12 and the base body 6, and the torques for screwing the connecting contacts 9, 12 into the receiving areas 17, 18 can be reduced to a minimum (manual screwing), since the adhesive layers subsequently cure.

Figure 4:
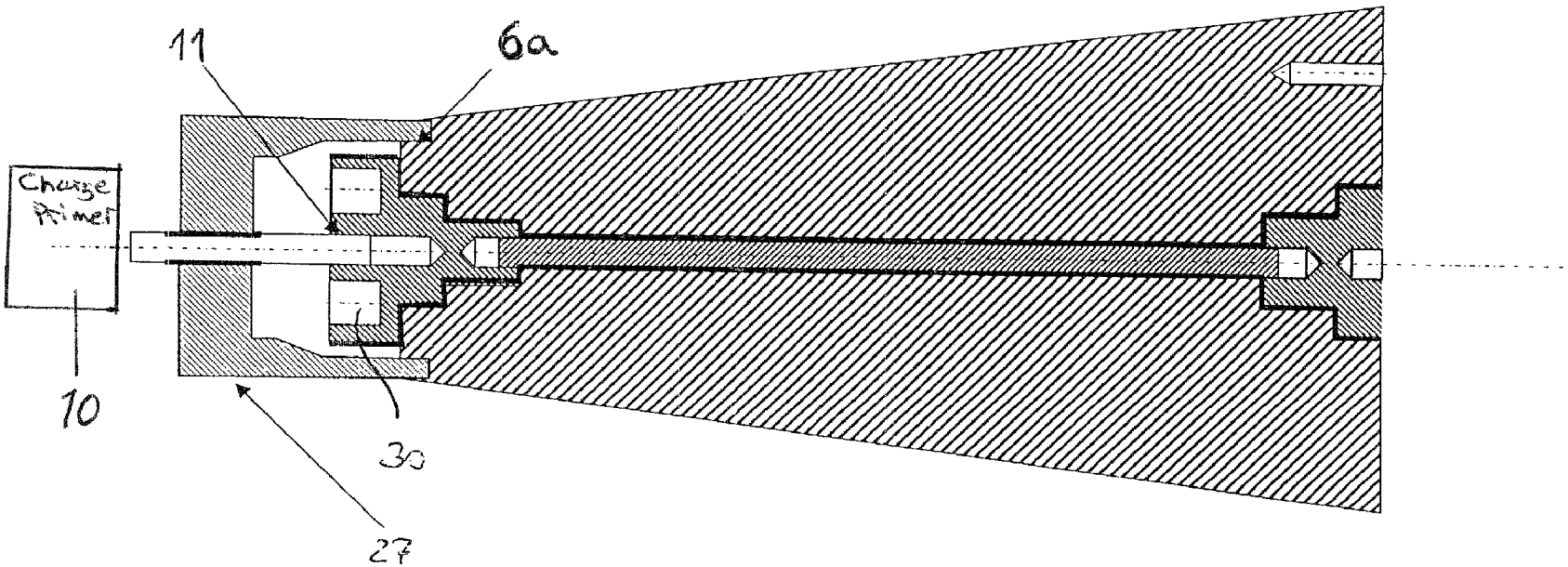

To be able to screw in the charge propellant primer 10 even after connection of the sabot projectile 1 with the shell casing in the corresponding casing base body of the shell casing, the end of the first connecting contact 9 that faces away from the base body 6 has a blind bore 100 that runs in the axial direction, into which the end of a plug contact 11, which can be connected with the charge propellant primer (shown schematically), can be inserted (FIG. 4).

To contact the ground wire of the propellant charge primer with the ground wire 22 of the tail end 6*a* of the projectile, a grounding screw cap 27 is provided, which can engage the coating-free blind bore 20 of the rear end 13 of the base body 6, if such a blind bore 20 is present.

Figure 3:
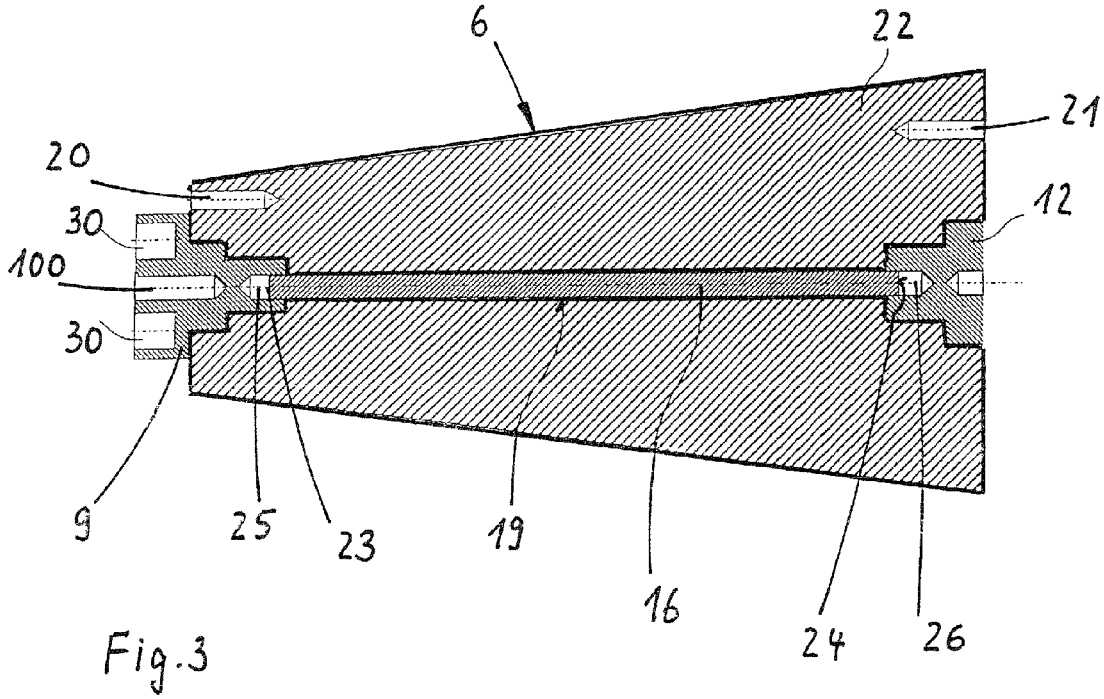

As is also apparent from FIGS. 3 and 4, in the illustrated embodiment, the first connecting contact 9 has two or more eccentrically arranged recesses 30, for example, for holding tracer compositions.

The invention can be used with all projectiles which, for example, have settable fuses and must have or should have a gastight electrical bushing.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A projectile comprising: a projectile body; a propellant charge primer; and a gastight electrical bushing for transmitting electric signals from a high-pressure region of the projectile to a low-pressure region of the projectile, the bushing including a metallic base body having an electrically insulating non-conductive coating on all surfaces thereof, and a metallic, electrically conducting inner conductor, wherein the metallic base body forms a ground wire, wherein only an insulated signal line is passed through a bore in the base body, the bore in the base body being covered with an electrically insulating non-conductive coating on all surfaces thereof, the signal line passing through the bore being insulated therefrom by the insulating coating on the inner surface of the bore, wherein the signal line essentially fills the bore, the base body forming a tail section, wherein the propellant charge primer is directly connected with the tail section so that the propellant charge primer is mounted from behind on the tail section, and direct contact between the propellant charge primer and the tail section is realized.

2. The projectile in accordance with claim 1, further comprising a plug contact, wherein the signal line has a first connecting contact with an axially extending blind bore on a side that faces away from the base body, into which blind bore an end of the plug contact is insertable, the plug contact being connectable with the propellant charge primer.

3. The projectile in accordance with claim 1, wherein the tail section is conical.

* * * * *